US007040601B2

(12) United States Patent
Chikahata et al.

(10) Patent No.: US 7,040,601 B2
(45) Date of Patent: May 9, 2006

(54) VALVE GUIDE FOR INTERNAL COMBUSTION ENGINE MADE FROM IRON BASE SINTERED ALLOY

(75) Inventors: Katsunao Chikahata, Nagareyama (JP); Koichiro Hayashi, Matsudo (JP); Katsuaki Sato, Wako (JP)

(73) Assignees: Hitachi Powdered Metals Co., Ltd., Chiba (JP); Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/499,026

(22) PCT Filed: Dec. 27, 2002

(86) PCT No.: PCT/JP02/13747

§ 371 (c)(1),
(2), (4) Date: Jul. 12, 2004

(87) PCT Pub. No.: WO03/060173

PCT Pub. Date: Jul. 24, 2003

(65) Prior Publication Data

US 2005/0040358 A1 Feb. 24, 2005

(30) Foreign Application Priority Data

Jan. 11, 2002 (JP) ..... 2002-004915

(51) Int. Cl.
*F16K 1/00* (2006.01)

(52) U.S. Cl. ..... 251/368; 123/188.3

(58) Field of Classification Search ..... 251/368; 123/188.3

See application file for complete search history.

(56) References Cited

U.S. PATENT DOCUMENTS

| | | | | |
|---|---|---|---|---|
| 5,076,866 | A * | 12/1991 | Koike et al. | 148/437 |
| 5,326,526 | A * | 7/1994 | Ikenoue et al. | 419/38 |
| 6,616,726 | B1 * | 9/2003 | Chikahata et al. | 75/246 |

FOREIGN PATENT DOCUMENTS

| | | |
|---|---|---|
| JP | B2 55-34858 | 9/1980 |
| JP | A 5-171908 | 7/1993 |

* cited by examiner

*Primary Examiner*—Justine R. Yu
*Assistant Examiner*—Peter deVore
(74) *Attorney, Agent, or Firm*—Oliff & Berridge, PLC

(57) ABSTRACT

Valve guides made of ferrous sintered alloy for internal combustion engines have improved durability of the valve stem without soft nitriding process. The valve guides include Cu: 8 to 20 mass %, C: 0.8 to 1.5 mass %, and at least one of MnS, $WS_2$, and $MoS_2$: 0.5 to 2 mass % and the balance of Fe, the valve guides have many pores, have a metal structure in which the copper phase dispersed in an iron pearlite matrix exists, and have a structure in which metal sulfides are dispersed between particles between the matrix and the copper phase.

7 Claims, No Drawings

VALVE GUIDE FOR INTERNAL COMBUSTION ENGINE MADE FROM IRON BASE SINTERED ALLOY

TECHNICAL FIELD

The present invention relates to valve guides made of ferrous sintered alloy, having excellent wear resistance, for internal combustion engines.

BACKGROUND ART

Many valve guides for intake valves or exhaust valves in internal combustion engines are made of ferrous sintered alloys. For example, a sintered alloy in which carbon is 1.5 to 4 mass %, copper is 1 to 5 mass %, tin is 0.1 to 2 mass %, phosphorus is 0.1 to 0.3 mass % and the balance is iron, having Fe—C—P ternary eutectic compound precipitates in an iron pearlite matrix, and in which graphite is dispersed, is described in Japanese Patent Application Publication No. 55-34858. Since this alloy has superior machinability and wear resistance, it is used in engines such as those of automobiles. Corrosion-resistant and heat-resistant superalloy (Japanese Industrial Standard (JIS) NCF), heat-resistant steel (JIS SUH), high speed tool steel (JIS SKH), and alloys obtained by treating a soft nitriding process on the above-mentioned alloys are used for many valve stems in intake valves and exhaust valves.

It is desirable for the valve stem to be subjected to a soft nitriding processing treatment in order to improve thermo-stability, wear resistance and fatigue properties. However, this processing requires special management for handling and disposal, etc., because a melted salt including a toxic cyanogen compound is used, and there is a problem of environmental protection in this process. Therefore, valve stem without the soft nitriding process is desirable, if possible. However, in the case of using a valve stem without the soft nitriding process, sliding damage (abrasion) is progressive for valve guides made of ferrous sintered alloy and the valve stems, and there is a possibility that abrasion would relatively increase because wear resistance in the valve stem without the soft nitriding process is relatively lower than that in the valve stem treated the soft nitriding process. In particular, in the intake side (intake), the phenomenon called "oil dropping" in which the lubricating oil flows downward into the combustion chamber, occurs, when lubricating oil is supplied in order to prevent the abrasion of the slide part between the valve guide and the valve stem. By the phenomenon, the amount of consumption of the lubricating oil increases and the adverse emission effects are generated. Therefore, porosity of sintered alloy and feed rate of lubricating oil may be adjusted so that the quantity of lubricating oil becomes moderate, in order to avoid this generation. As a result, friction conditions become relatively severe.

DISCLOSURE OF THE INVENTION

Objects of the present invention are to provide valve guides for internal combustion engines, made of ferrous sintered alloy with excellent durability of the valve stem without soft nitriding process.

Valve guides of the present invention have Cu at 8 to 20 mass %, C at 0.8 to 1.5 mass %, and at least one of MnS, $WS_2$, and $MoS_2$ at 0.5 to 2 mass %, and the balance is composed of Fe, and many pores exist; there is a metal structure in which the copper phase dispersed in an iron pearlite matrix exists, and metal sulfides are dispersed in between particles of the matrix and the copper phase. The reason for limiting the composition of the present invention is explained as follows.

Iron Based Matrix

Iron based matrix produces fundamental properties such as material strength and the wear resistance, and the iron based matrix in the present invention has a pearlite structure in which carbon of graphite is diffused in the matrix formed from pure iron powder during sintering. The combined carbon content of the iron based matrix is about 0.8% of the eutectoid phase between iron and carbon, and iron based matrix in which a large amount of cementite is precipitated is not desirable. Graphite powder remaining as free carbon is also included in a part of the added graphite powder.

C

The total carbon content in the sintered alloy effects the radial crushing strength and the machinability of the valve guide, and the wear amount of the valve guide and the valve stem. The better the machinability of valve guide becomes, with the less is the total carbon content. The radial crushing strength shows the highest value when total carbon content is about 1 mass %, and decreases when total carbon content is more or less than about 1 mass %, and a total carbon content which exceeds 1.5 mass % is not desirable. The wear amount of the valve guide and the valve stem shows the lowest value when the total carbon content is about 1 mass %, and increases when the total carbon content is less than 0.8 mass %. From these facts, the total carbon content of the range from 0.8 to 1.5 mass % shows small wear amount, high radial crushing strength, and good machinability.

Cu

Copper improves conformability and wear resistance of the valve stem when copper is dispersed in a particulate phase in the iron based matrix of the sintered alloy. It is desirable that the copper is added in the form of copper powder. It is suitable for the grain size of the copper powder according to the above-mentioned is relatively coarse so as to obtain a dispersed copper phase. For example, the copper powder in which the grain size is less than 100 mesh sieve, and the quantity of the subsieve fraction is 10 to 30 mass %, is preferable. Copper slightly diffuses in iron based matrix by the sintering, and it actually forms a structure of pure copper. While the sintering temperature is made to be 1100 to 1300° C. which is a little higher than the copper melting point, in order to obtain strength, the diffusion of the copper into the iron is controlled by keeping time in maximum sintering temperature, and the above-mentioned carbon is dissolved in the iron at about 0.8 mass %. The copper content also effects various characteristics. The machinability improves with increase in the copper content. The radial crushing strength decreases with increase in copper content. The wear amount of the valve guide and the valve stem shows the most preferable value when the copper content is about 15 mass %, and increases when the copper content is 5 mass %. From these facts, the copper content of the range from 8 to 20 mass % shows small wear amount, high radial crushing strength, and good machinability.

Metal Sulfide (MnS, $WS_2$, $MoS_2$)

Ferrous sintered alloy valve guide having a structure in which the copper is dispersed at 8 to 20 mass % in the iron based matrix of a pearlite matrix, has higher radial crushing strength than the conventional valve guide made of the ferrous sintered alloy, and does not occurs adhesion. However, ferrous sintered alloy valve guide having a structure in which the copper is dispersed at 8 to 20 mass % in the iron based matrix of a pearlite matrix, is inferior in wear resistance and machinability to the conventional valve guides made of ferrous sintered alloys. The solid lubricant may be contained in the alloy in order to improve the above-mentioned wear resistance and machinability. As solid lubricant, manganese sulfides (MnS), tungsten disulfide ($WS_2$), molybdenum disulfide ($MoS_2$), enstatites ($MgSiO_3$), boron nitride (BN), calcium fluoride (CaF), etc., can be used. However, metal sulfide is superior, especially manganese sulfide is most superior, in these solid lubricant because the radial crushing strength reduction is small and the wear resistance is best. When the content of metal sulfide increases, the machinability is improved, and the radial crushing strength is reduced. The wear amount of the valve guide and the valve stem are small in the case in which the content of metal sufide is about 1 to 1.5 mass %, and increases in the case in which the content of metal sulfide is less than 0.5 mass %. The wear amounts thereof are increased even if the content of metal sulfide is 3 mass %. From these facts, metal sulfide content of the range from 0.5 to 2 mass % shows small wear amount, high radial crushing strength, and good machinability.

Density of the Valve Guide

Density of valve guide having pores with the ability to hold oil therein and having satisfactory strength is 6.4 to 6.8 g/cm$^3$.

BEST MODE FOR CARRYING OUT THE INVENTION

Next, this invention is explained in further detail by way of concrete examples.

(1) Manufacture and Performance Test of Sintered Alloy Samples

PRACTICAL EXAMPLES a) Raw Material Powder

Iron powder; KIP-300A, made by Kawasaki Steel: grain size-100 mesh Sieve

Copper powder; #35 made by Japan Energy: grain size-100 mesh sieve

Graphite powder; CPB made by Nihon Graphite Industry: grain size-150 mesh sieve

Solid lubricant powder; Manganese sulfide (MnS), tungsten disulfide ($WS_2$), molybdenum disulfide ($MoS_2$), enstatite ($MgSiO_3$), boron nitride (BN), calcium fluoride (CaF)

Zinc stearate powder b) Mixed Powder

By using the above mentioned raw material powders, mixed powders of Samples 1 to 7 shown as follows were prepared. The amounts are in mass %. Zinc stearate of 0.75 mass % was added to all samples.

Sample 1: 89% iron powder+10% copper powder+1% graphite

Sample 2: 99% sample 1+1% MnS

Sample 3: 99% sample 1+1% $WS_2$

Sample 4: 99% sample 1+1% $MoS_2$

Sample 5: 99% sample 1+1% $MgSiO_3$

Sample 6: 99% sample 1+1% BN

Sample 7: 99% sample 1+1% CaF c) Compacting of Powder and Sintering

The above-mentioned sample powders 1 to 7 were compacted into cylindrical valve guide shapes in die, and the compacts were sintered by being heated to a maximum temperature of 1130° C. in a reducing gas. The density of each sample for evaluating the performance was made to be 6.6 g/cm$^3$. Each sintered compact contained carbon of 0.95 mass % in total. In the iron microstructure of each sintered compact, the entire face was of pearlite (the combined carbon content was about 0.8%), and there were particulate copper phase in this microstructure.

COMPARATIVE EXAMPLE

A valve guide made of the above-mentioned conventional sintered alloy was made as a comparative example sample. A mixed powder was obtained by respectively mixing iron powder, copper-tin alloy powder, phosphorus ferro-alloy powder, copper-tin alloy powder, phosphorus ferro-alloy powder, and graphite powder in specified quantity, a compact was obtained by compacting this mixed powder, and the comparative example sample was obtained by sintering this compact. Composition of the sintered compact of the comparative example was carbon: 2 mass %, copper: 3 mass %, tin: 1 mass %, phosphorus: 0.2 mass %, and the balance of iron. And microstructure of the sintered compact was the Fe—C—P ternary eutected compound precipitated in the pearlite matrix by diffusing carbon into iron matrix.

The following tests were tested on valve guides made of sintered compacts of the above mentioned samples 1 to 7 and the valve guide made of a compact of the comparative example.

Radial Crushing Test (MPa)

The radial crushing strength was measured according to determination of radial crushing strength for the oil-impregnated sintered bearing described in JIS Z2507-1979.

Machinability Test

Turbine oil in which kinematic viscosity at 400° C. was 56 cSt was impregnated in each valve guide in which the inside diameter was 6.4 mm, and each valve guide was inserted under pressure in a hole of a housing to be fixed to a matrix of a drilling machine. A reamer made of cemented carbide with 7 mm outer diameter was fixed to the drilling machine, and was inserted in an inner hole of samples at a rotation rate of 1000 rpm and a load of 31N. The machinability was evaluated by cutting time (second) which could process 10 mm of the axial distance in the reamer machining.

Wear Test

The valve guide machined by reamer processing was fixed in testing equipment, inside diameter wear amounts (μm) of the valve guide, and wear amount (μm) of the valve stem were measured after they ran for 10 hours at an environmental temperature of 500° C. at a rotation rate of 3000 of the valve stem, and at a radial load of 3 kgf, by using a non soft nitriding valve stem which was made of martensite heat resistant steel SUH11 (JIS G4311).

The results of the radial crushing strength and wear amount test are given in Table 1. In Table 1, properties of each sample of the practical example are shown in an index in making characteristics of the sample of the comparative example to be 100. "VG" is "valve guide", and "VS" is "valve stem" in the Table.

TABLE 1

| | | Radial crushing strength (MPa) | Wear amount of VG (μm) | Wear amount of VS (μm) | Characteristics of compositions |
|---|---|---|---|---|---|
| Practical Examples | Sample 1 | 153 | 187 | 250 | No solid lubricant |
| | Sample 2 | 143 | 13 | 25 | Sample 1 + MnS |
| | Sample 3 | 124 | 40 | 50 | Sample 1 + $WS_2$ |
| | Sample 4 | 126 | 50 | 34 | Sample 1 + $MoS_2$ |
| | Sample 5 | 132 | 108 | 34 | Sample 1 $MgSiO_3$ |
| | Sample 6 | 108 | 145 | 50 | Sample 1 + BN |
| | Sample 7 | 154 | 120 | 50 | Sample 1 + CaF |
| Comparative Example | | 100 | 100 | 100 | Conventional sintered alloy |

According to Table 1, characteristics of the samples of practical examples including metal sulfide may be superior to those of the valve guide of the sample of the comparative example. In particular, the Fe-10% Cu-0.85% C-1% MnS material of sample 2 was best. In the reamer processing time of the machinability test, index of the sample 2 was 78 when index of the sample of the comparative example was made to be 100; therefore, sample 2 was superior.

(2) Comparison of Content of Cu, C, and MnS

Next, in the above-mentioned sample 2, effects of various content of Cu, C and MnS to the properties of the valve guide were respectively compared. And proper values of content of Cu, C, and the metal sulfide were respectively decided. At that time, the methods for the radial crushing test and machinability tests were the same as the above-mentioned. However, in the abrasion test, the load was increased to 5 kgf, and the time was increased to 30 hours in comparison with those of the above-mentioned conditions. In the comparison, the index of the above-mentioned sample 2 was made to be 100. In criteria to determine the limited scope of the present invention, the cutting time was made so that the index was under 120, the radial crushing strength was made so that that the index was 60 or more, the wear amount of the valve guide was made so that the index was 140 or less, and the wear amount of the valve stem was made so that the index was 250 or less. Even if the index in the wear amount of the valve stem is relatively large, the value is allowable because it is about several μm.

a) Comparison of Cu Content

Under conditions that Fe-1% C-10% MnS was made to be constant, samples of 4 kinds of valve guide in which the content of Cu was 5 mass %, 10 mass %, 15 mass %, and 20 mass % were produced. Test results for these samples are given in Table 2.

TABLE 2

| Cu content (mass %) | Cutting time (S) | Radial crushing strength (MPa) | Wear amount of VG (μm) | Wear amount of VS (μm) |
|---|---|---|---|---|
| 5 | 125 | 108 | 172 | 220 |
| 10 | 100 | 100 | 100 | 100 |
| 15 | 88 | 85 | 88 | 50 |
| 20 | 87 | 79 | 132 | 200 |

According to Table 2, the Cu content was desirable in the range of 10 to 15 mass %. When the Cu content is increased, the machinability improves. However, in this case, the radial crushing strength is reduced. The wear amount of the valve guide decreased when the Cu content was 10 to 15 mass %, and increased when the valve was under 10 mass % or over 15 mass %. The wear amount of the valve stem was all within tolerance. From these facts, the range of Cu content was made to be 8 to 20 mass %, considering wear amount and machinability of the valve guides.

b) Comparison of C Content

Under the conditions that Fe-10% Cu-1% MnS was made to be constant, samples of 4 kinds of valve guide in which the content of C was 0.8%, 1%, 1.2%, and 1.5% were produced. Test results for these samples are given in Table 3.

TABLE 3

| C content (mass %) | Cutting time (S) | Radial crushing strength (MPa) | Wear amount of VG (μm) | Wear amount of VS (μm) |
|---|---|---|---|---|
| 0.8 | 87 | 83 | 139 | 250 |
| 1 | 100 | 100 | 100 | 100 |
| 1.2 | 103 | 83 | 132 | 100 |
| 1.5 | 109 | 68 | 139 | 200 |

According to the Table 3, the C content was desirable in the range of 1 to 1.2 mass %. When the C content is increased, the machinability deteriorates. The radial crushing strength and wear resistance showed the highest value when C content was 1%, and tends to decrease when the C content was 1% more or less. Combined carbon content with the iron from the viewpoint of the structure is about 0.8 mass %; therefore, the balanced C is precipitated as cementite and free carbon. Machinability is reduced with the increase in carbon content because hard and brittle cementite is increased with the increase in carbon content. When the stem is abraded by hard and brittle cementite, the grains abraded off act as abrasive particles and abrade the valve guide itself. These characteristics are respectively within tolerances, and the range of the C content is made to be 0.8 to 1.5 mass %.

c) Comparison of the MnS Content

Under conditions that Fe-10% Cu-1% C was made to be constant, samples of 5 kinds of valve guide in which the content of MnS was 0.5%, 1%, 1.5%, 2% and 3% were produced. Test results of these samples are given in Table 4.

TABLE 4

| MnS content (mass %) | Cutting time (S) | Radial crushing strength (MPa) | Wear amount of VG (μm) | Wear amount of VS (μm) |
|---|---|---|---|---|
| 0.5 | 104 | 102 | 144 | 225 |
| 1 | 100 | 100 | 100 | 100 |
| 1.5 | 99 | 88 | 107 | 50 |
| 2 | 94 | 78 | 134 | 150 |
| 3 | 87 | 73 | 218 | 550 |

According to the Table 4, the MnS content was good properties in the range of 1 to 2 mass %. When the MnS content increased, the radial crushing strength decreased, and the machinability increased. The wear resistance was desirable when the MnS content was 1 to 1.5 mass %, and tends to be reduced when MnS content was 1 to 1.5 mass %, and tends to be reduced when MnS content is 1% more or less. When the MnS content was 3 mass %, the wear amount increased on both the valve guide and the valve system. From these facts, the range of MnS content is made to be 0.5 to 2 mass %.

As shown the above, according to the valve guide of the present invention, the conformability with the valve stem is improved, sliding abrasion damage was difficult to occur, the wear resistance of the valve guide and the abrasiveness on the valve stem as an opposing material are improved by the relatively soft copper being moderately dipersed in the iron based matrix in the pearlite structure and by the lubricating effect of metal sulfide. From these facts, a valve stem having suitable characteristics can be obtained without having to perform soft nitriding processing.

What is claimed is:

1. A valve guide made of ferrous sintered alloy for an internal combustion engine, consisting of:

Cu: 8 to 20 mass %, C: 0.8 to 1.5 mass %, at least one of MnS, $WS_2$, and $MoS_2$: 0.5 to 2 mass %, and balance of Fe;

wherein the valve guide consists of a metallographic structure consisting of:

an iron pearlite matrix, copper phase which is dispersed in said matrix, pores, and metal sulfides which are dispersed in said matrix, said copper phase and pores.

2. A valve guide made of ferrous sintered alloy for an internal combustion engine according to claim 1, wherein the valve guide is used in combination with a valve stem of iron based anticorrosive thermostable superalloy, a heat resistant steel, or a high speed tool steel on which no soft nitriding processing has been treated.

3. The valve guide made of ferrous sintered alloy for an internal combustion engine according to claim 1, wherein free carbon is dispersed in said matrix.

4. The valve guide made of ferrous sintered alloy for an internal combustion engine according to claim 1, wherein the copper phase is dispersed in a particulate phase in said matrix.

5. The valve guide made of ferrous sintered alloy for an internal combustion engine according to claim 1, wherein said copper phase is formed by a powder having a grain size of less than 100 mesh sieve and quantity of sub sieve fraction of 10 to 30 mass %.

6. The valve guide made of ferrous sintered alloy for an internal combustion engine according to claim 1, wherein said metal sulfide is contained at 1 to 1.5 mass %.

7. The valve guide made of ferrous sintered alloy for an internal combustion engine according to claim 1, wherein said valve guide has a density of 6.4 to 6.8 $g/cm^3$.

* * * * *